US005709613A

United States Patent [19]

Sheraw

[11] Patent Number: 5,709,613

[45] Date of Patent: Jan. 20, 1998

[54] ADJUSTABLE BACK-SHAFT GOLF PUTTER

[76] Inventor: Dennis R. Sheraw, 1244 Queen Cross Street, St. Croix, Virgin Islands (U.S.), 00820

[21] Appl. No.: 662,878

[22] Filed: Jun. 12, 1996

[51] Int. Cl.[6] ..... A63B 53/06

[52] U.S. Cl. ..... 473/248; 473/307; 473/313; 473/340; 473/341

[58] Field of Search ..... 473/295, 296, 473/307, 313, 314, 334, 335, 340, 341, 349, 244, 245, 246, 247, 248, 305, 306

[56] References Cited

U.S. PATENT DOCUMENTS

| | | | |
|---|---|---|---|
| D. 264,366 | 5/1982 | Roskopf et al. | D21/217 |
| D. 329,889 | 9/1992 | Scott | D21/217 |
| 556,042 | 3/1896 | Briggs | 473/305 |
| 1,518,316 | 12/1924 | Ellingham | 473/337 |
| 1,657,972 | 1/1928 | Rowe | 473/248 |
| 2,478,468 | 8/1949 | Drake | 473/313 |
| 3,675,923 | 7/1972 | Allen et al. | 473/313 |
| 3,989,257 | 11/1976 | Barr | 473/251 |
| 4,519,612 | 5/1985 | Tsao | 472/248 |
| 4,702,477 | 10/1987 | Solomon | 473/313 |
| 4,722,528 | 2/1988 | Tsao | 473/254 |
| 4,815,740 | 3/1989 | Williams | 473/248 |
| 5,160,141 | 11/1992 | Crews | 473/313 |
| 5,267,733 | 12/1993 | Szokola | 473/313 |
| 5,340,104 | 8/1994 | Griffin | 473/340 |
| 5,344,141 | 9/1994 | Smith | 473/314 |
| 5,429,356 | 7/1995 | Dingle | 473/315 |
| 5,462,279 | 10/1995 | Culpepper | 473/314 |
| 5,470,063 | 11/1995 | Fisher | 473/248 |
| 5,577,726 | 11/1996 | Fenton | 473/340 |

*Primary Examiner*—Sebastiano Passaniti
*Assistant Examiner*—Stephen L. Blau
*Attorney, Agent, or Firm*—Cowan, Liebowitz & Latman, P.; Morey B. Wildes

[57] ABSTRACT

A golf putter is provided whose hosel is connected horizontally to the rear surface of the putter head and curves 90° to vertical, attaching to a putter shaft. Two threaded pegs are set into the rear surface of the putter head, and a number of variable weights having threaded holes accommodate the threaded pegs can be interchangeably mounted onto the rear surface of the putter head in order to adjust the putter balance and weight characteristics as desired. In addition, the angle between the shaft and the vertical can be varied to any angle for either a right- or a left-handed golfer. In a first embodiment, the putter head comprises a recess in its rear surface into which the hosel is rotatably mounted and a threaded bore extending from the top surface down through to the recess. The hosel, which has holes around the circumference of its end, is placed into the recess and a threaded screw is inserted through the bore and into one of the hosel holes, thereby setting the hosel and its attached shaft at a desired angle. In another embodiment, the horizontal region of the hosel is composed of two portions joined by fitted ratchet teeth and set together at a desired angle by a threaded screw that extends horizontally through the horizontal region of the hosel. The hosel can be set so that the shaft angle may be set at no less than 10° from vertical to conform with U.S. Golf Association rules and regulations.

23 Claims, 3 Drawing Sheets

ADJUSTABLE BACK-SHAFT GOLF PUTTER

BACKGROUND OF THE INVENTION

This invention relates to the field of golf putters and, more particularly, to the field of adjustable golf putters.

Over the years, various designs of golf putters have been created in an effort to construct a golf putter that would provide an advantage to a golfer's putting game. A myriad of different club faces, heads, shafts and grips have been devised in order to furnish a solution to a most difficult part of the game of golf. Unfortunately, some putters that have been found to aid certain golfers and to improve their putting accuracy have not benefited other golfers at all. Often this is due to the different physical characteristics of the golfers. That is to say, because golfers are in all different physical sizes and shapes, and have all different physical strengths, weaknesses and abilities, a putter that increases the putting ability of one golfer may actually interfere with comfortable putting by another. For instance, the preferred angle that a golf putter shaft makes with the putting surface or the preferred weight or balance of the putter may vary from golfer to golfer, such that each golfer may prefer a different putting angle or putter weight.

A putter with its shaft axis at an angle of 10° from vertical will allow the golfer to stand close to the ball, while a putter shaft angle of 20° from vertical will allow the golfer to stand further from the ball. In addition, although the rules of the United States Golf Association (USGA) do not allow an angle of less than 10° from vertical in USGA-sponsored competition, a non-regulation putter with a shaft angle of less than 10° from vertical will allow the golfer to stand very close to the ball. It is, therefore, desirable to provide a putter in which the shaft angle can be modified as desired in order to allow the golfer to stand the most comfortable distance from the ball and to hold the putter at the most comfortable angle. It is also desirable that the shaft angle of such a putter be modifiable such that the shaft angle may be set from either side of the putter head, thereby allowing the putter to be used by both right- and left-handed golfers.

Several previous designs have been contemplated in which the angle of the putter shaft may be modified or set to the comfort of the golfer. Two such putter designs incorporating adjustable hosels are shown in U.S. Pat. Nos. 5,267,733 (Szokola) and 5,340,104 (Griffin). However, in the putters disclosed therein, the shaft angle can be adjusted only once, i.e., prior to use of the putter, and the shaft angle is then set using adhesive so that it is no longer variable. Thus, once the shaft angle has been set to one golfer's comfortable position, the putter might not be comfortably used by another golfer. It is further desirable to provide a putter whose shaft is movable to allow the shaft angle to be varied an unlimited number of times depending on the preference of the particular golfer using the putter.

Furthermore, each golfer may prefer a different weight or balance to the putter head. This is especially true for a putter whose shaft angle may be varied, because the putter balance when the shaft is at a first angle will invariably be different than when the shaft is at another angle. This is also appropriate for a putter or other golf club that can be used by more than one golfer, in order to enable each golfer to adjust the putter head weight and balance as desired. It is desirable, therefore, to provide a putter whose head weight or balance is adjustable.

SUMMARY OF THE INVENTION

In accordance with the above and other objects of the invention, a golf putter is provided having a putter head whose shaft and hosel are attached to the back or following side of the head. In general, the shaft will be a minimum angle of 10° from vertical, according to USGA regulations. In a preferred embodiment, the putter head comprises two threaded pegs, each approximately ¼ inch in diameter and approximately ¼ inch in length, protruding from the back of the putter head on either side of the hosel. These two threaded pegs will be located at equal distances from the ends of the head and the hosel and at equal distances from the top and bottom edges of the head. These pegs will accommodate weighted metal composite balls that can be screwed onto the rear of the putter head in varying weight amounts so that the head weight of the putter can be varied. This allows a player to customize the putter to his particular weight and balance conditions.

In addition, this invention allows the golfer to change the degree of lie of the putter head by changing the degree of the putter shaft as it attaches to the putter head. In a first alternative embodiment, the hosel, which connects the shaft to the putter head, is adjustably attached to the back of the putter head via a threaded screw that protrudes down through the putter head into a hole in the hosel. The end of the hosel will have set holes around its circumference to accommodate the screw and to allow a selected shaft angle in either direction from vertical to be chosen and fixed in place with the set screw.

In another embodiment, the hosel is affixed to the back of the putter head. However, in the region of the hosel that exits horizontally from the putter head, the hosel is composed of two separate pieces that are connected together in a ratchet-type joint. The two hosel pieces are fitted together such that, after the desired shaft angle is selected, the pieces are then set together by a threaded screw that extends horizontally through the two hosel pieces from outside the hosel. The ratchet joint will allow for the setting of any shaft angle in either direction from vertical, thus accommodating either right- or left-handed golfers.

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which.

DETAILED DESCRIPTION OF THE INVENTION

Figure 1:
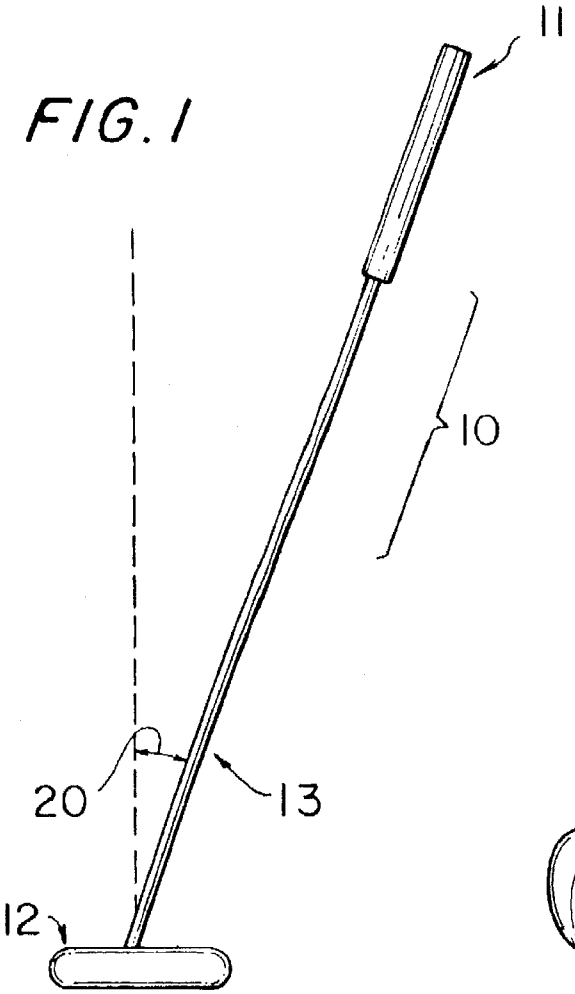
FIG. 1 is a front elevational view of a preferred embodiment of the putter of the present invention.

The following detailed description will be best understood with reference to the accompanying figures, in which like reference numerals indicate like or corresponding features throughout. FIG. 1 shows an improved putter 10 corresponding to a preferred embodiment hereof. The putter 10 comprises a shaft 13, a grip 11 and a putter head assembly 12.

Figure 2:
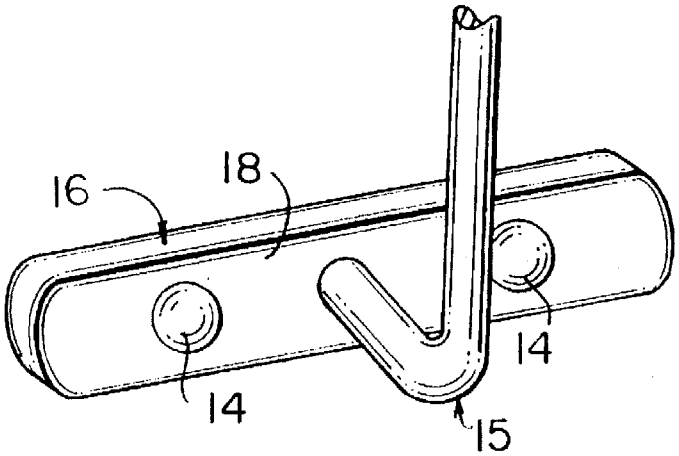
FIG. 2 is a top, side, back, perspective view of the putter head.

Putter shaft 13 is typically of a type well known in the art and may have varying lengths and shapes to accommodate a variety of putting styles. It is a specific feature of the putter 10 of the current application that the putter head assembly 12 of the present invention may be used with any known or anticipated putter shaft 13. In a preferred embodiment, as illustrated in FIG. 2, a hosel 15 is provided to allow connection of shaft 13 to putter head assembly 12. Typical shafting techniques such as placing the shaft over the hosel (shaft over technique) or providing a socket on the hosel within which the shaft fits may be used. As is known in the art, putter 10 is used by gripping shaft 13 typically on grip section 11 and swinging the putter head assembly 12 so that its front face 19 strikes a golf ball. The object of putting is to strike the golf ball in such an accurate way so that it rolls across the ground and into the cup.

In a preferred embodiment of the invention, putter head assembly 12 comprises a hosel 15 and two balance weights 14 attached to the rear, non-striking face 18 of putter head 16. Preferably, putter head 16 is comprised of metal, i.e., brass, steel or any other metal normally used in putter construction. Putter head 16 is configured in a long flat oval shape which is approximately 4¼ inches wide by 1 inch high by ½ inch thick. The edges of the putter head 16 are rounded throughout and there are no flanges of any sort. Hosel 18 has a rounded 90° shape so as to connect vertically-oriented shaft 13 to putter head 16 and is mounted or connected horizontally to rear, non-striking face 18 of putter head 16 at the exact balance points of the horizontal and vertical planes. Hosel 15 provides a strong visual cue of the path of the ball and therefore acts as an aiming device on putter 10. In a typical putter, in which the shaft is attached to the top of the putter head, there is no structure corresponding to hosel 15 as configured in FIGS. 2 and 3, and thus the direction of travel of the ball upon contact is much more difficult to predict. This type of golf putter, in which the hosel attaches to the rear, non-striking face of the putter head, is known in the art and is shown in various forms in U.S. Pat. Nos. 2,478,468 (Drake), 3,989,257 (Barr), Des. 264,366 (Raskopf et al.), and 5,267,733 (Szokola), among others. The advantages of this type of golf putter will be described later.

Figure 3:
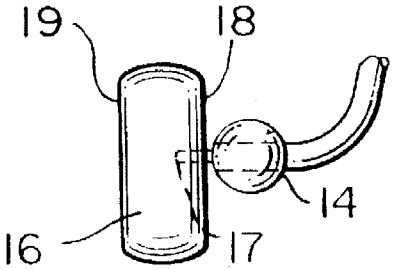
FIG. 3 is a side elevational view of the putter head.

According to the preferred embodiment, as shown in FIGS. 2 and 3, a threaded peg 17 protrudes horizontally from back face 18 of putter head 16 on each side of hosel 15. These two threaded pegs 17 will be located at the center of each side of back face 18 of putter head 16, such that each is at equal distances from the end of putter head 16 and from hosel 15 and at equal distances from the top and bottom edges of putter head 16. Pegs 17 will accommodate weighted metal composite balls 14 that match putter head in appearance. Balls 14 will have a threaded hole to allow them to be screwed onto the threaded pegs 17 and onto back face 18 of putter head 16. Balls 14 or weights of variable weight amounts will be available so that the head weight of putter 10 can be changed prior to each golf round depending upon conditions. This allows a player to customize his putter to his style and conditions. Putter head 16 will weigh approximately 295 grams without weights and can be weighted to a maximum of approximately 330 grams. Varying weights of balls available and used by the golfer can produce a gram weight of varying totals between 295 and 330 grams.

The presence of variable weighted balls 14 affixed to rear face 18 of putter head 16, shown in FIGS. 2 and 3, allows for greater sensitivity and control of the golf ball under varying conditions of the green to include such factors of moisture on the green, hardness of the green, length of grass on the green and elevation changes of the green. It also allows for the user to tailor the golf putter to his desired weight and balance characteristics. In typical prior art putters, no such weight attachments were provided and there was no structure corresponding to weight balls 14. It should be noted that while weights 14 are shown in FIGS. 2 and 3 as spherical in shape, any shape, such as cubes, cones, cylindrical disks or the like, may be used as weight attachments as long as an appropriate number of grams is maintained for each weight.

Referring now to FIG. 3, in the preferred embodiment, hosel 15 is connected to rear face 18 of putter head 16 and is aligned with the center axis of putter head 16. This arrangement provides that all of the force transferred from shaft 13 will be directed along hosel 15 to increase the accuracy and control of ball direction. Furthermore, as shown in FIG. 3, the mounting point of hosel 15 is provided at a point behind putter head 16. This configuration provides a greatly increased moment of inertia about the shaft axis than would be the case if shaft 13 itself were mounted so that the projection of shaft 13 itself were to pass through the center of mass of putter head 16 from above.

As physics dictates, the larger the moment of inertia about an axis of rotation the greater the resistance to rotation about that axis. Thus, were a projection of the shaft axis to pass through the center of mass, the moment of inertia about that rotational axis would be minimized so that the club face would tend to rotate about that axis. However, where the shaft axis is positioned apart from the center of mass, the moment of inertia is much greater and therefore there is a greater resistance to rotation about axis so that there is a reduced likelihood of the putter face rotating about this axis. This increase in the moment of inertia about the shaft axis results in the putter face tending to stay square, or aligned with the ball, during the back swing and forward swing of the putter prior to contact with a golf ball. This in turn results in a greatly decreased likelihood of the putter face being opened or closed (off of square) with respect to the ball and thus greatly increases the likelihood that the ball will be struck so that it follows the intended line of travel, in the preferred embodiment along the direction of the hosel axis. The result will be that once the hosel axis is aligned with the desired direction of travel of the ball, there is a significantly decreased likelihood that this direction will change through rotation of the putter head by the time the ball is struck. The user can further aid this result by adding weights 14 to putter head 16, thereby increasing the mass of putter head 16 and the moment of inertia above the shaft axis.

Referring primarily to FIGS. 1–3, the benefits of a putter made in accordance with the preferred embodiment of the present invention may be better understood. The act of putting primarily consists of two components, direction and speed. The component of direction generally consists of first reading a green to determine the best line of the putt to provide that the ball will intersect the cup and then aligning the putter so that the ball will travel along that line. Putter 10 made in accordance with the preferred embodiment of the present invention greatly increases the likelihood that a user of the putter will indeed properly align the putter head so that the ball travels along the intended path. This directional assistance is primarily provided by the extended shape of putter hosel 15. In the preferred embodiment, putter striking face 19 is provided generally perpendicular to hosel 15 so that a ball struck by striking face 19 will be directed in a line corresponding to the direction of hosel 15.

Furthermore, as was previously described, the location of the hosel 15 with respect to the center of the mass of the putter head 12 greatly decreases the likelihood that the alignment of the putter head 12 will change after the putter head is initially aligned along the desired path. Once the user has determined the desired path and properly aligned the putter, the putter head must be swung. Frequently with prior art putters, the swinging of the putter results in the putter face deviating from the desired alignment, thus causing the ball to follow an improper path. Over the years a wide variety of grip and swing techniques have been developed to prevent misalignment of the putter during the putting stroke. In fact, these techniques have typically emphasized a very firm grip on the putter shaft intended to physically hold the attitude of the face constant along with minimal movement of the user's body, typically rotation from the shoulders, during the stroke. While these techniques do help to prevent the putter from becoming misaligned during the putting stroke, the firmness of the grip greatly reduces the sensitivity of the user to the putter through his hands (the feel) and the shoulders-only movement is very unnatural as most users would tend to rotate about their waists, and results in a further reduction of sensitivity to the proper "feel" of the putt. The result is that, while the user has a reduced tendency to misalign the putter during the stroke, much of the feedback and natural feel for the stroke is lost, increasing the likelihood of missed putts and decreasing the predictability of putting accuracy. Another putting technique which has developed in response to the inherent lack of putter face control in previous designs, is a stroke in which the wrists are held rigid so that there is no natural hinging motion. However, this technique also reduces feel and results in a lack of predictability in putting accuracy. Both of these techniques result in a tendency to tense the control muscles which further reduces control and accuracy. Furthermore, the user must mentally concentrate on the grip and shoulder movement or wrist rigidity, in addition to the direction and speed of the putt, further increasing the chances of a missed putt by causing mental and physical confusion on the part of the user. Thus, the present putter greatly enhances the likelihood that the golf ball will be struck along the desired line since the tendency of the putter head 16 is to remain in proper alignment almost regardless of the grip or stroke technique. The result is that the user is free to use a comfortable grip and more natural stroke to improve the feel of the stroke and consequently, accuracy. The accuracy improvement of the present invention is arrived at because of the inherent function due to the design of the putter and therefore, virtually any putting stroke or technique with which a user feels comfortable, will take advantage of the design improvements of the present putter and allow the user to focus upon the putt itself and not compensation for the design defects of the putter.

The second element of putting, speed, relates to the force with which the ball is hit and thereby the distance the ball will travel. As is immediately apparent, even a ball struck along the proper path will not go in the cup if the ball is not struck the proper distance. Although the line of the putt is generally more important than the speed of the putt, because even if the ball is struck too hard, if the path of the ball intersects the cup there is a possibility that the ball will hit the back of the cup and drop into the cup, speed is nevertheless a very important consideration. A putter made in accordance with the preferred embodiment of the present invention also increases the ability to putt with the proper speed. Initially, as was previously discussed, the user's feel for a putt using the present invention is significantly increased since the user may effectively employ a motion which feels best to him, his most natural stroke, in using the putter. Additionally, this preferred embodiment allows the user to adjust the weight of putter head 12 by changing weights 14 on rear face 18 of putter head 12, thus providing even greater feel and feedback during the putting stroke. This increased sensitivity provides a user with much more feedback about the contact with the ball through the putter and thus enables the user to get a much greater feel for the proper stroke for varying distances. Furthermore, as the user's confidence increases due to the alignment and weight characteristics of the present putter, the user will be more likely to strike the ball hard enough to reach the cup and will be less concerned with missing the cup and having the ball go beyond the cup. As this confidence level increases, a greater percentage of the user's putts will in fact go into the cup since the user will be likely to use a more aggressive stroke built on the knowledge that the ball will travel on his intended line.

Aside from the confidence and feel considerations, the structural design of the present putter also provides for greater speed control. As is known to user's of golf clubs and putters, every putter has a spot on the contact surface known as the "sweet spot". This "sweet spot" is similar to the sweet spot frequently referred to in baseball bats, tennis rackets and other sports equipment used to strike a ball. The sweet spot is the contact point on the contact surface at which the most efficient energy transfer between the putter and ball will occur. In typical prior art putters, the "sweet spot" is frequently in a position other than where it would be expected. Furthermore, as the sweet spot was not necessarily located at the center of the putter face, alignment of the prior art putters so that contact was made at the sweet spot could be difficult and inconsistent. With the present putter 10, the sweet spot coincides with the position of intersection of hosel 15 and putter head 16 and is possibly even widened by the presence of weights 14 attached to putter head 16. Thus, a user will always know where the sweet spot is located, and contact with the ball will almost always be made at the sweet spot. Further, the natural lines formed by the outside edges of the hosel's silhouette form accurate and easily perceived sighting devices.

Also, as has been recognized, the optimum putting stroke mimics the path of a pendulum swinging. However, as was previously discussed, the variety of techniques that have been developed to prevent putter misalignment and the prior art putters that require such specialized techniques tend to detract from the pendulum-like motion of a putter stroke. For example, a firm grip and movement from only the shoulders discourages a user from swinging the putter in a pendulum like motion. However, since the present putter 10 reduces the need for a firm grip and unnatural swing movement of the body, a more nearly pendulum like stroke may be used with the present putter. Referring to FIG. 2, a putter made in accordance with the present invention is shown which maximizes the ability to use a pendulum like putter stroke. As previously discussed, hosel 15 is provided such that a projection of shaft 13 passes behind the center of mass of putter head 16. Thus, when putter 10 is swung, the swing will tend to mimic the action of a pendulum. Thus, the user need only cooperate with the tendency of putter head 16 to initiate the back swing, stop the back swing at the desired point and cooperate with the tendency of the putter head again to initiate the forward swing, and follow through ball contact to utilize a pendulum-like stroke. This action, as discussed above, minimizes the tendency for the putter line to become misaligned during the back stroke because the face does not have the undesirable tendency to open and close.

Another feature of the preferred embodiment is the variable relative angular relationship of shaft 13 and hosel 15 with respect to a vertical plane aligned with the hosel axis and perpendicular to the putting surface. As indicated in FIG. 1, shaft 13 is provided at an angle 20 with respect to a vertical plane aligned with the horizontal hosel axis. The putter of FIG. 1 is shown configured for a right-handed user, and angle 20 provides that shaft 13 is angled towards such a right-handed user when putter head assembly 12 is aligned with the ball. Angle 20 is preferably between about 10° and 30° and is mostly preferably about 15° . Angle 20, when combined with a typical shaft length of a putter, provides for the optimum alignment of a user's eyes with putter head 16 to rest squarely on the ground. Not all golfers are comfortable with this angle, however, because of different height and physical characteristics of golfers.

Figure 4:
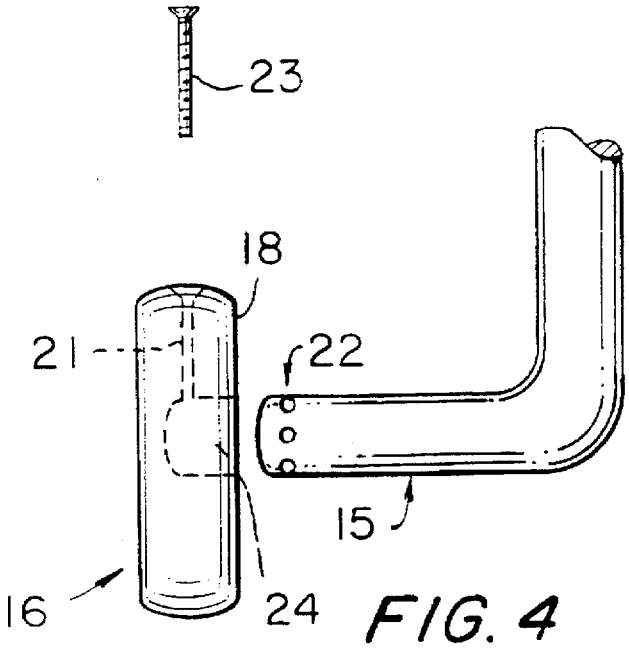
FIG. 4 is an exploded side elevational view of a first embodiment of a putter head with an adjustable hosel.
Figure 5:
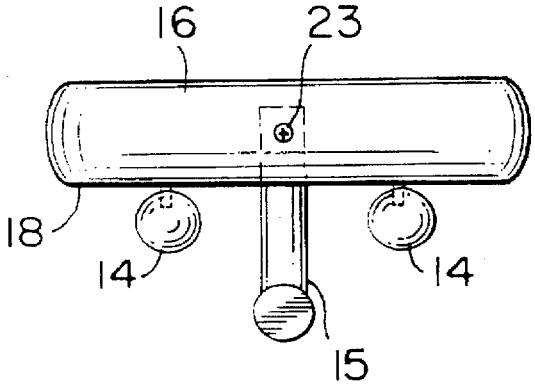
FIG. 5 is a top plan view thereof.

FIGS. 4 and 5 show an embodiment of putter 10 in which angle 20 may be varied. As shown in FIG. 4, wherein weights 14 are not shown, a recess 24 is drilled, machined or cast in the center of back side 18 of putter head 16 for receiving hosel 15. Hosel 15 is then mounted rotatably within recess 24 and connected to putter head 16. Narrow, threaded bore 21 is drilled, machined or cast down into the top center of putter head 20 through to recess 24, and a narrow, threaded set screw 23 may be threaded into bore 21 such that it extends through into recess 24. Numerous small holes 22 are drilled, machined or cast into the outside surface of hosel 15 at the horizontal end of hosel 15 that is inserted into recess 24 in putter head 16. Holes 22 at the end of hosel 15 accommodate the end of set screw 23, allowing screw 23 to be inserted therein to thereby firmly attach hosel 15 to putter head 16. Holes 22 may optionally be threaded to allow screw 23 to be threaded therein. The shaft angle 20 of putter 10 in FIG. 1 can be changed to custom fit putter 10 to the user by first unscrewing screw 23 from bore 21, next turning hosel 15 within recess 24 such that hosel 15 and shaft 13 are at the desired angle 20, and then screwing screw 23 into bore 21 and into the appropriate hole 22 in hosel 15.

In the common use of putter 10, the desired angle 20 of shaft 13 (the degree of lie) can be varied depending upon the height, as well as the stance and style, of the user. The alternative embodiment shown in FIGS. 4 and 5 would also permit use of varying shaft angles 20 of putter 10 by both left- and right-handed golfers. It should be noted that, since USGA rules do not allow a lie angle of less than 10° from vertical, in a preferred embodiment of this invention, no holes in the hosel will exist that would allow the degree to be fixed at less than the 10° from vertical. Within this design, a putter 10 that is to be used in conformance with USGA rules will have holes 22 at the end of hosel 15 located in such a manner that would permit only angles of lie of 10° or greater from vertical, both left and right, in order to conform with U.S. Golf Association regulations. Alternatively, a putter 10 that is to be used recreationally could allow angles of less than 10° from vertical to be set. This embodiment again incorporates the use of variable weighted balls 14 attached to rear face 18 of putter head 16 as previously described in the preferred embodiment, as shown in FIG. 5.

Figure 6:
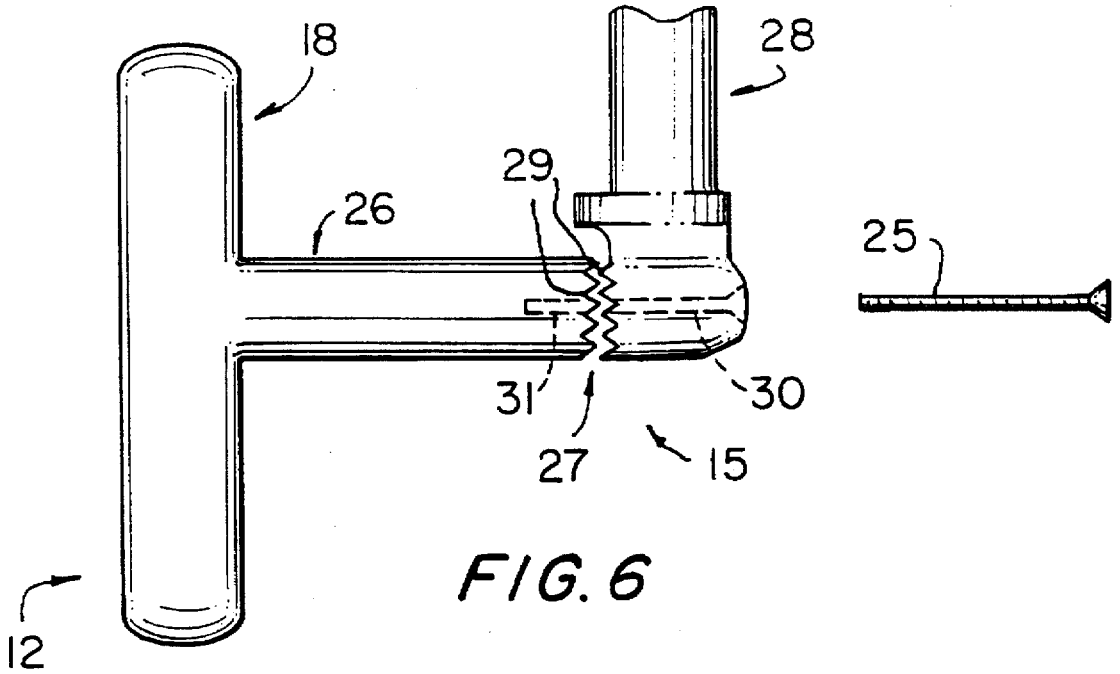
FIG. 6 is an exploded side elevational view of an alternative embodiment of a putter head with an adjustable hosel.
Figure 7:
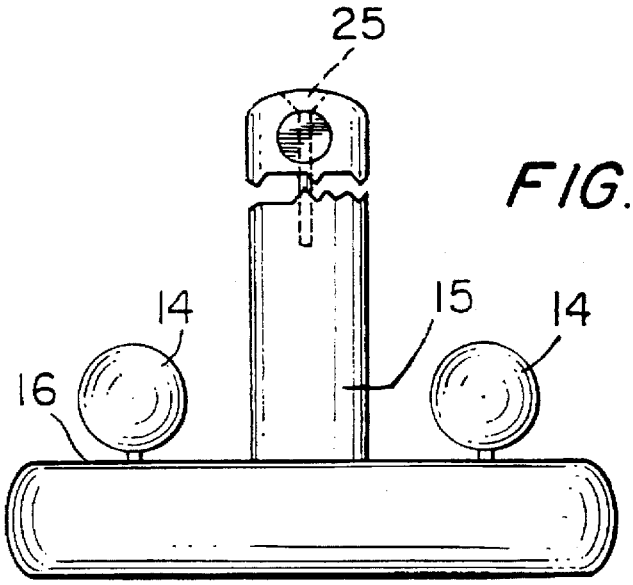
FIG. 7 is a top plan view thereof.

FIGS. 6 and 7 show a second alternative embodiment of putter 10 in which angle 20 may be varied, employing a split hosel with a ratchet variable fitting. This second alternative embodiment is comprised of hosel 15 permanently affixed to rear side 18 of putter head 12. As shown in FIG. 6, hosel 15 is split into two portions, a first portion 26 that is horizontal and attached to the rear face 18 of putter head 12 and a second portion 28 that has a vertical region attached to shaft 13, a corner region and, optionally, a horizontal region attached thereto. The two sections 26,28 of hosel 15 are fitted together by a ratchet connection 27 comprised of radially-oriented meshed teeth 29 on the facing ends of hosel sections 26,28. The ends of hosel sections 26,28 that meet will have radially-oriented meshed teeth 29 cut into them to allow rotation of sections 26,28 relative to each other about a horizontal axis in order to enable adjustment of shaft 13 to the desired position relative to the putter head 16. When hosel sections 26,28 are rotated relative to each other along the horizontal hosel axis, meshed teeth 29 will allow sections 26,28 to still be fitted together. A narrow, threaded bore 30 is drilled, machined or cast into hosel section 28 along the horizontal hosel axis from the outside of vertical hosel piece 28 through the end that faces hosel section 26, and a coaxial narrow, threaded bore 31 is drilled, machined or cast into hosel section 26 along its horizontal axis through the end that faces hosel section 28. A narrow, threaded set screw 25 may be threaded into bores 30,31 such that hosel sections 26,28 are held together. Threaded set screw 25 enters hosel 15 from the end opposite putter head 16 and runs horizontally from the outside of vertical section 28 of the hosel 15, through bore 30 and into the end of horizontal piece 26 of hosel 15. Thus, once angle 20 is selected, set screw 25 will then be threaded through bores 30,31 in order to fix hosel pieces 26,28 together.

This second alternative embodiment will allow shaft angle 20 of putter 16 to be changed to custom fit the user and will also permit use of varying shaft angles 20 by both left- and right-handed golfers. It should be noted that USGA rules require the lie angle to be no less than 10° from vertical. Thus, in a preferred embodiment, ratchet connection 27 of a putter 10 that is to be used in conformance with USGA rules is designed in such a manner that would permit only angles of lie of 10° or greater from vertical, both left and right, in order to conform with U.S. Golf Association regulations. Alternatively, a putter 10 that is to be used recreationally will have its ratchet joint 27 designed such that appropriate teeth 29 in the appropriate locations could allow shaft angles of less than 10° from vertical to be set. This embodiment again incorporates the use of variable weighted balls 14 attached to rear face 18 of putter head 16 as previously described in the preferred embodiment, as shown in FIG. 7.

Thus, an adjustable back-shaft golf putter is provided. One skilled in the art will appreciate that the present invention can be practiced by other than the described embodiments, which are provided for purposes of illustration and not limitation, and that the present invention is limited only by the claims that follow.

I claim:

1. An adjustable golf putter comprising:

an elongated linear shaft;

a putter head having a top surface, a from surface defining a substantially planar surface for contacting a golf ball, a rear surface opposed to said front surface, a recess in said rear surface and a threaded bore for accommodating a threaded screw extending downward through said putter head from said top surface into said recess; and a substantially L-shaped hosel having a first end for attachment to said shaft along a substantially vertical axis and a second end for attachment to said rear surface of said putter head along a substantially horizontal axis, said second end of said hosel comprising a plurality of holes about its circumference for receiving said threaded screw; and weight means removably mounted on said rear surface of said putter head for adjusting the weight and balance of said golf putter:

whereby said hosel can be rotated about said substantially horizontal axis within said recess in said putter head to set said attached shaft at a desired angle from vertical and said screw can be threaded into said threaded bore and inserted into one of said holes in said hosel to set said hosel within said recess and said attached shaft at said desired angle from vertical.

2. The adjustable golf putter of claim 1 further comprising mounting means for removably mounting said weight means on said rear face of said putter head.

3. The adjustable golf putter of claim 2 wherein said mounting means comprises threaded pegs set within the rear face of said putter head.

4. The adjustable golf putter of claim 3 wherein said weight means have threaded holes therein to accommodate said threaded pegs and to allow said weight means to be removably mounted onto said threaded pegs.

5. The adjustable golf putter of claim 4 wherein said weight means can be in the shape of a sphere, cone, cylinder, disk or any other suitable shape.

6. The adjustable golf putter of claim 2 wherein said weight means comprises various interchangeable sizes and weights thereof to allow a user to vary the weight and balance of said golf putter.

7. The adjustable golf putter of claim 6 wherein said weight means can be in the shape of a sphere, cone, cylinder, disk or any other suitable shape.

8. The adjustable golf putter of claim 1 wherein said screw can be removed from said one of said holes in said hosel to allow said hosel to be rotated within said recess, such that said hosel can be reset within said recess and said attached shaft can be reset at a different desired angle from vertical.

9. The adjustable golf putter of claim 1 wherein said plurality of holes are arranged about the circumference of said hosel second end such that said attached shaft may be set at an angle of from 0° to 90° in either direction from vertical.

10. The adjustable golf putter of claim 1 wherein said plurality of holes are arranged about the circumference of said hosel second end such that said attached shaft may be set at an angle of greater than 10° in either direction from vertical.

11. The adjustable golf putter of claim 1 wherein said plurality of holes are arranged about the circumference of said hosel second end such that said attached shaft may be set at an angle of less than 30° in either direction from vertical.

12. An adjustable golf putter comprising:

an elongated linear shaft;

a putter head having a front surface defining a substantially planar surface for contacting a golf ball, a rear surface opposed to said front surface and having a recess therein, a top surface, and a threaded bore extending downward through said putter head from said top surface into said recess;

a hosel having a first end for attachment to said shaft along a substantially vertical axis and a second end rotatably mounted along a substantially horizontal axis within said recess in said rear surface of said putter head, said second end comprising a plurality of holes about the circumference thereof; and a threaded screw;

whereby said hosel can be rotated about said substantially horizontal axis within said recess in said putter head to set said attached shaft at a desired angle from vertical and said screw can be threaded into said threaded bore and inserted into one of said holes in said hosel to set said hosel within said recess and said attached shaft at said desired angle from vertical.

13. The adjustable golf putter of claim 12 wherein said screw can be removed from said one of said holes in said hosel to allow said hosel to be rotated within said recess, such that said hosel can be reset within said recess and said attached shaft can be reset at a different desired angle from vertical.

14. The adjustable golf putter of claim 12 further comprising weight means removably mounted on said rear surface of said putter head for adjusting the weight and balance of said golf putter.

15. The adjustable golf putter of claim 14 further comprising mounting means for removably mounting said weight means on said rear face of said putter head.

16. The adjustable golf putter of claim 15 wherein said mounting means comprises threaded pegs set within the rear face of said putter head.

17. The adjustable golf putter of claim 16 wherein said weight means have threaded holes therein to accommodate said threaded pegs and to allow said weight means to be removably mounted onto said threaded pegs.

18. The adjustable golf putter of claim 15 wherein said weight means comprises various interchangeable sizes and weights thereof to allow a user to vary the weight and balance of said golf putter.

19. An adjustable golf putter comprising:

an elongated linear shaft;

a threaded screw;

a putter head having a top surface, a front surface defining a substantially planar surface for contacting a golf ball, a rear surface opposed to said front surface, a recess in said rear surface, and a threaded bore for accommodating said threaded screw extending downward through said putter head from said top surface into said recess; and a hosel having a first end for attachment to said shaft along a substantially vertical axis and a second end for rotatable attachment within said recess in said rear surface of said putter head along a substantially horizontal axis, said second end of said hosel comprising a plurality of holes about its circumference for receiving said threaded screw; and weight means removably mounted on said rear surface of said putter head for adjusting the weight and balance of said golf putter;

whereby said hosel can be rotated about said substantially horizontal axis within said recess in said putter head to set said attached shaft at a desired angle from vertical and said screw can be threaded into said threaded bore and inserted into one of said holes in said hosel to set said hosel within said recess and said attached shaft at said desired angle from vertical.

20. The adjustable golf putter of claim 19 wherein said screw can be removed from said one of said holes in said hosel to allow said hosel to be rotated within said recess, such that said hosel can be reset within said recess and said attached shaft can be reset at a different desired angle from vertical.

21. The adjustable golf putter of claim 19 wherein said plurality of holes are arranged about the circumference of said hosel second end such that said attached shaft may be set at any angle of from 0° to 90° in either direction from vertical.

22. The adjustable golf putter of claim 19 wherein said plurality of holes are arranged about the circumference of said hosel second end such that said attached shaft may be set at an angle of greater than 10° in either direction from vertical.

23. The adjustable golf putter of claim 19 wherein said plurality of holes are arranged about the circumference of said hosel second end such that said attached shaft may be set at an angle of less than 30° in either direction from vertical.

* * * * *